United States Patent [19]

Geloen

[11] Patent Number: 4,693,917

[45] Date of Patent: Sep. 15, 1987

[54] PROCESS AND APPARATUS FOR PREPARING A FILLING MATERIAL, PARTICULARLY FOR AN ARTICLE GIVING BODY PROTECTION

[76] Inventor: Roland A. E. Geloen, 21 rue de Lorraine, 59100 Roubaix, France

[21] Appl. No.: 796,221

[22] Filed: Nov. 8, 1985

[30] Foreign Application Priority Data

Nov. 9, 1984 [FR] France ..... 84 17110

[51] Int. Cl.[4] ..... G21C 3/06; D01B 1/48; D01B 3/00

[52] U.S. Cl. ..... 428/6; 19/0.27; 19/4

[58] Field of Search ..... 428/6; 19/0.27, 4

[56] References Cited

U.S. PATENT DOCUMENTS

| | | | |
|---|---|---|---|
| 1,574,617 | 2/1926 | Gallagher | 21/55 |
| 1,620,303 | 3/1927 | Uhrig | 19/4 |
| 2,213,316 | 9/1940 | Koga | 19/4 |
| 2,706,143 | 4/1955 | Florio | 8/94.1 |
| 2,714,561 | 8/1955 | Frederick | 117/55 |
| 2,715,086 | 8/1955 | Frederick | 154/44 |
| 2,925,315 | 2/1960 | Pasternak et al. | 8/94.1 |
| 2,926,061 | 2/1960 | Pasternak et al. | 8/94.1 |
| 3,320,675 | 5/1967 | Chaikin et al. | 34/16 |
| 3,892,909 | 7/1975 | Miller | 428/371 |
| 4,065,599 | 12/1977 | Nishiumi et al. | 428/402 |
| 4,418,103 | 11/1983 | Tani et al. | 428/4 |
| 4,555,421 | 11/1985 | Yasue | 428/6 |

FOREIGN PATENT DOCUMENTS

| | | |
|---|---|---|
| 2318264 | 11/1977 | France . |
| 296582 | 9/1928 | United Kingdom . |
| 1143715 | 3/1985 | U.S.S.R. . |

*Primary Examiner*—John E. Kittle
*Assistant Examiner*—Patrick J. Ryan
*Attorney, Agent, or Firm*—Fisher, Christen & Sabol

[57] ABSTRACT

This invention relates to a process for the treatment of insulating materials in the supple, fluffy state, such as down, wherein the fluff of the down is subjected to a physical treatment adapted to take the filaments of the fluff into a substantially radial position, giving the fluff its maximum volume in which it is stabilized by the superficial deposit of a resin. The apparatus for carrying out the process comprises a dehydration enclosure in the form of a rotating drum with inner blades, hot air inlet and upper evacuation. The invention is more particularly applicable to the treatment of down for filling duvets, sleeping bags or the like.

11 Claims, 3 Drawing Figures

PROCESS AND APPARATUS FOR PREPARING A FILLING MATERIAL, PARTICULARLY FOR AN ARTICLE GIVING BODY PROTECTION

The present invention relates to a process for the preparation and treatment of filling materials in the divided state and oflow density,-of fluffy structure and intended more especially for making supple envelopes for protection of the body.

The invention relates more particularly to the preparation, treatment and conditioning of materials such as down intended for making envelopes for thermally protecting the body, such as eiderdowns, duvets, anoraks, winter clothes, sleeping bags, etc. . .

Applicant has observed that the filling power, during production, and the insulating power, during use, of the material constituted by down, depends largely on its sensitivity to damp.

Furthermore, experience has shown that the insulating and thermal protection power of a body insulating cover (sleeping bag, anorak or other garment) is much higher and more efficient when such cover is used dry.

Now, it is precisely when the aggressivity of the outside conditions is at its maximum (damp cold) that the protecting cover loses part of its efficiency, being given its sensitivity to damp.

It is therefore desirable to be able to use body protection structures which, whilst enjoying a high coefficient of insulation, are largely independent of the influence of humidity, so as to present an effective barrier and defence against the cold, both under damp, and more particularly aggressive conditions, and under dry cold conditions.

It is a precise object of the process according to the present invention to improve and considerably increase the power of insulation of the material used by dimensionally increasing the volume of the individual fluff which is blocked in its increased dimensional structure whilst it is rendered very largely insensitive to the outside damp.

It is known to treat the down before it is used, to give it various properties which improve its keepability and resistance to ageing agents such as parasites.

French Patent No. 76 20744 teaches incorporating in the feather cleaning liquid products such as synthetic resins; however, such treatment, which is carried out in liquid phase (and which concerns feathers), does not increase the volume of the individual elements and remains without effect on hygrometric protection.

U.S. Pat. Nos. 2,714,561 and 2,715,086 also relate to, the treatment of feathers which may receive a coating of wax, resin or elastomer to improve their filling power; however, such treatment is provided for feathers precisely for the purpose of rendering their properties similar to those of down; and the treatment remains without effect on the dimensional structure of the product. In addition, it is also effected in liquid phase.

On the contrary, the present invention, by increasing the volume of each individual piece of fluff, makes it possible to immobilize a larger quantity of air in the same weight of matter and consequently to increase the efficiency of the product thus treated.

Another, equally important, purpose of the invention is to stabilize the down in the dimensional structure which it will thus have been given.

Such mechanical stability of the down is accompanied by an insensibilization of the material with respect to the detrimental influences of a damp atmosphere by giving the product the capacity of resisting the penetration of damp in the volume of air imprisoned within the structure of the fluff.

Moreover, the treatment according to the invention will enable the protective structures (duvets, sleeping bags, anoraks) to be maintained under improved and simplified conditions by increasing the life duration of the article.

Finally, the invention makes it possible to give lower-quality down, for example second-class down or used down, renovated properties of heat resistance by modifying their dimensional structures and their resistance to damp.

To this end, the invention relates to a process for the treatment of insulating materials in the supple, fluffy state, such as down, and intended for filling body-protecting structures, process wherein the fluff of the down is subjected to a physical treatment of dehydration adapted to take the filaments of the fluff into a substantially radial position, giving the fluff its maximum volume.

The dehydration phase is preferably carried out by suspending the down fluff in a stream of hot, dry air for the time necessary to ensure thorough dehydration, provoking the volumic expansion of the down.

The invention will be more readily understood on reading the following description with reference to the accompanying drawings, in which.

Figure 1:
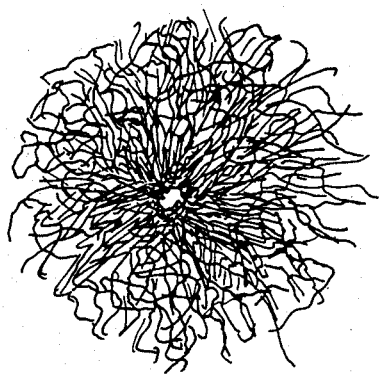
FIG. 1 shows a schematic view of an individual piece of down fluff as used within the framework of embodiment of the present invention, and seen before the treatment according to the invention.
Figure 2:
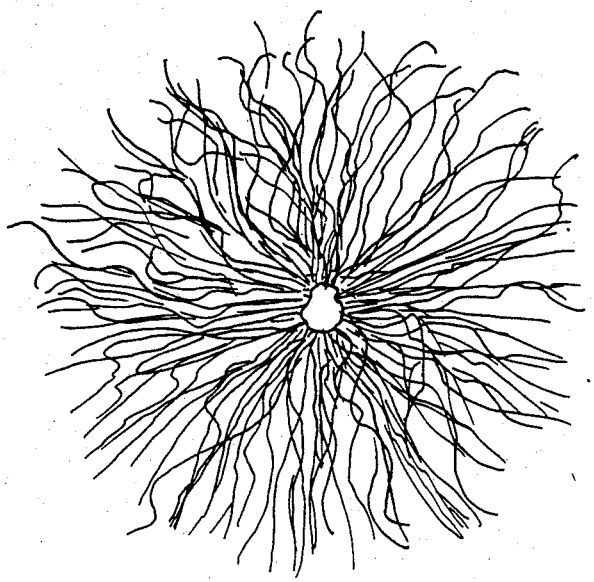
FIG. 2 shows the same fluff after treatment.

Referring now to the drawings, FIGS. 1 and 2 show the dimensional structure of the individual piece of fluff before treatment (FIG. 1) and after treatment (FIG. 2), respectively.

It is seen that the heat treatment according to the invention, of which the operational phases will be described hereinafter, has made it possible to modify the dimensional structure of the fluff which has considerably expanded under the effect of heat.

The multiple filaments of which the fluff is composed are, in the initial state, largely intermixed and compressed on one another, consequently reducing the total volume that they occupy from the central core; this corresponds to the natural state of the down when it is on the body of the living animal, the down in that case being largely impregnated with the natural oils exuded by the animal's body and necessarily being compressed by the top layers of plumage.

This compressed state is then often aggravated by the steps of treatment of the down in liquid phase followed by compression thereof for transport purposes.

The heat treatment, which will be described hereinafter, makes it possible to develop the filaments which resume a general, substantially radial position from the central core, said filaments expanding and causing the down fluff to occupy a volumic space corresponding substantially to a sphere whose radius corresponds to the average length of the filaments.

It is seen that this structural modification which will be stabilized and crystallized by the subsequent treatment, will enable the fluff to acquire a volume increased in a proportion of between 30 and 50% with respect to the initial volume.

It follows that the mass of air constituting the actively insulating matter of the filling is increased in the same proportions.

Consequently, the same quantity of down (by weight) after treatment according to the invention, occupies a volume 30 to 50% greater and therefore has an increased insulating power in the same proportions.

The operational treatment according to the invention starts with a dehydration phase.

Dehydration may be effected by known chemical means, for example by exposing the down in an atmosphere of air in contact with a humidity-absorbing product such as quick lime, silica gel, calcium chloride, etc. . . .

Dehydration by heat is preferred to this relatively slow method, such thermal dehydration being effected in the same apparatus which subsequently serves for the following phase of stabilization by coating with a coating material.

Figure 3:
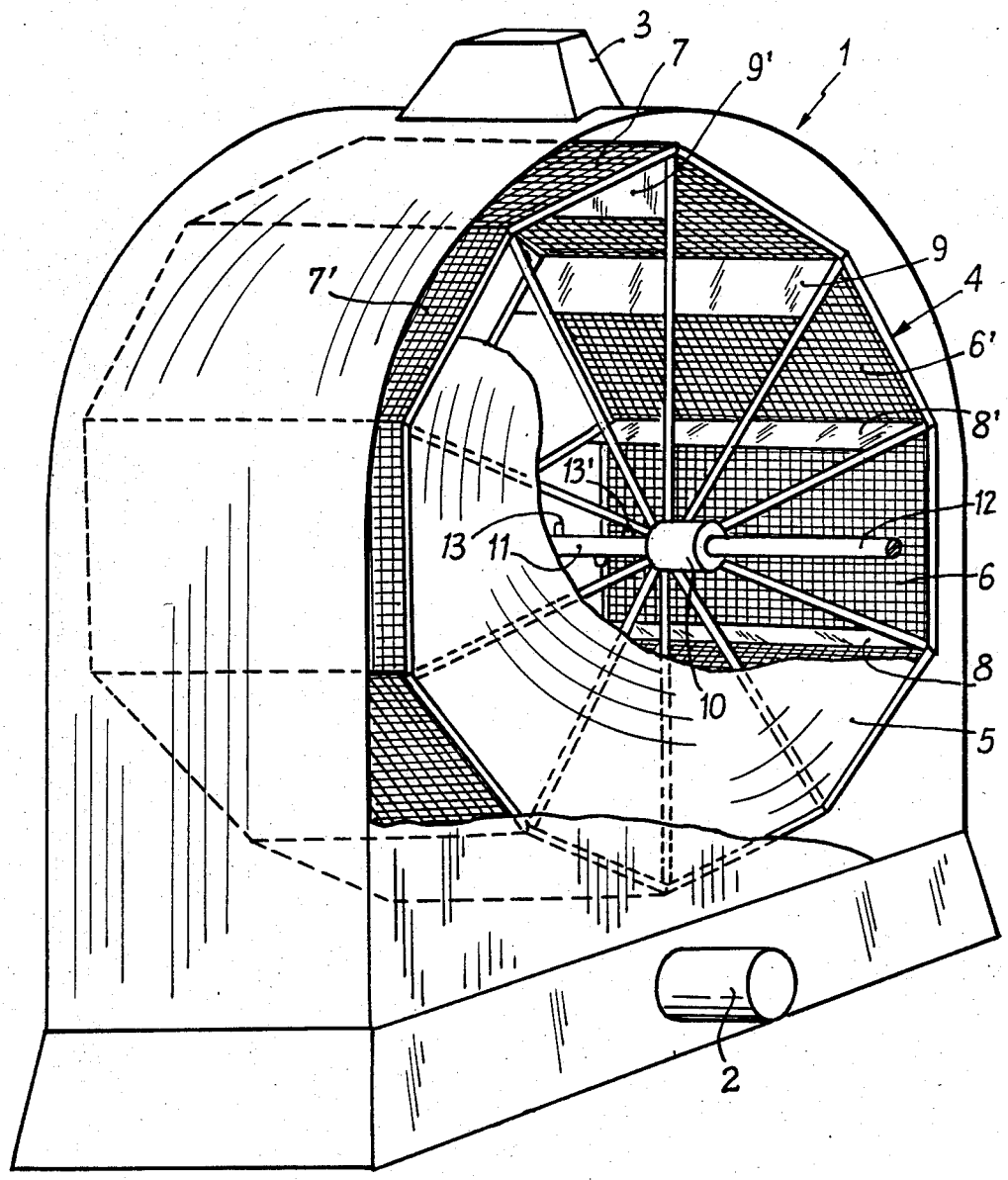
FIG. 3 shows a schematic view, in perspective and with parts torn away, of an apparatus for carrying out the treatment according to the invention.

Referring now to FIG. 3, the apparatus used for carrying out the invention comprises an enclosure 1 provided with an inlet 2 at its base and an opening 3 for evacuation at the top, and constituted by a caisson.

Inside this enclosure is mounted a rotating drum 4 of which the lateral walls 5 are solid and preferably constituted by glass plates, cooperating with lateral glass walls of the enclosure 1, thus allowing visibility inside the cylinder in order to monitor operations. Openings for access are provided (not shown in the Figure).

The peripheral walls 6, 6', 7, 7' of the drum are constituted by a perforated structure, for example perforated sheet metal or a grid (for example in expanded metal).

Consequently, the interior of the drum is in communication with the gaseous phase prevailing within the enclosure 1.

Radial blades 8, 8', 9, 9' are disposed towards the periphery of the drum in order to improve mixing of the matter.

At the base and via inlet 2 there is insufflated a stream of hot air taken progressively to 100° and coming from a blower or a heating source (not shown); the hot air is evacuated at the top 3 and it may advantageously be recycled after passage over means for eliminating humidity and for reheating.

At the end of operation, the mean hygrometric degree of the air imprisoned within each piece of down fluff has been reduced to a level of between 20 and 25% corresponding to the dimensional state of the down as shown in FIG. 2.

It will be understood that the drum is driven in rotation by conventional means about hub 10; slow rotation allows continuous mixing of the down fluff introduced into the drum; the fluff drops slowly to the bottom where it is taken up by blades 8, 8', etc... and lifted towards the upper part where it escapes by gravity and falls slowly downwardly, meeting the ascending stream of hot air to which it gradually and regularly abandons its humidity. For instance, the physical treatment of dehydration can include a suspension of the down fluff in a dry gaseous atmosphere at a temperature of the order of 100° C.

In the subsequent phase corresponding to the water-repelling treatment, the down remains present in suspension in the drum which is still being driven in slow rotation (one to two revolutions per minute).

In this phase, the ascending stream of hot air has been stopped and the injection pipe 11 which occupies the central axis of the drum and which opens to the outside at 12, connected to a source of pressure, is used for insufflating into the volume of the drum the, solution constituted by a coating resin in an organic solvent, in the state of mist or fog.

The inner axial pipe 11 is provided to this end with injection nozzles 13, 13' which spray into the interior of the drum a mist constituted by the resin in solution in the organic solvent.

The latter is supplied via the outer pipe 12 under high pressure (for instance, greater than 3 kilos per $cm^2$, including 8 to 10 kilos per $cm^2$).

During this period, the down in suspension and driven in eddies associated with the slow movement of the drum, is regularly impregnated on its surface with the particles of solution, at the level of the individual filaments of the down.

Rapidly evacuating solvents will preferably be chosen, the solvents being evacuated via the upper outlet 3.

Water-repellant resins will preferably be chosen from the group including fluorocarbon resins and silicon resins.

The proportion of resins for 20 kilos of down will be of the order of 40 to 50 grams in one liter of organic solvent.

At the end of treatment, when substantially all the solvent is eliminated, the resin being deposited and constituting a superficial film along the filaments constituting each piece of fluff, the treatment terminates in the polymerization phase in the course of which air taken to 130° C. is insufflated into the enclosure containing the drum, whilst continuing the slow movement of rotation and of stirring of the mixture.

A perfectly homogeneous assembly is thus obtained in which all the individual pieces of fluff have substantially the same structure and the same coating.

At the temperature of 130° C., the resin polymerizes, the chemical bonds which are established to obtain the chains of high molecular weight giving the film of resin its final mechanical structure, make it possible to crystallize the fluff in the expanded state to which the preceding phase of dehydration and rise in temperature will have led.

At the end of operation, the assembly is left to cool in order to obtain an expanded, developed down stabilized in this inflated dimensional structure and of which the hygrometric degree is reduced to 25% maximum.

This degree will then be maintained whatever the conditions of use and the ambient medium in which the article and the filling down that it contains will be placed.

In fact, the presence of the film of waterrepellant resin on the filaments, thanks to the high surface tension of the film of resin with respect to the water vapour, enables the down to repel the ambient humidity-laden air, and the dry air contained in the interstices between the filaments of each piece of fluff remains in place without hygrometric exchange.

The product having undergone the treatment is immediately used for filling finished products and articles such as duvets, sleeping bags, anoraks, etc. . .

The down thus used and which will have undergone the treatment described hereinbefore presents an increase in volume varying from 30 to 40% depending on the quality; this means that, in order to obtain the same insulation, 30 to 50% less matter may be used, which represents a saving of up to 50% in the price of raw material.

The process according to the invention advantageously allows not only a considerable improvement in the properties and qualities of new down, but also recuperation and renovation of used down.

Used down which is 4 to 5 times cheaper than new down may, thanks to the process of the invention, have the same properties and qualities as new down, which enables used down to be recovered and means a considerable saving in raw material.

Tests and controls conducted by Applicant have made it possible to compare the adiathermic power of the down treated in accordance with the invention with respect to a conventional down.

The tests were run in accordance with standard NF G 07 107.

The adiathermic power on a reference duvet filled with conventional down at a rate of 600 grams per square meter was established at PA=88.2%.

The same tests showed that a duvet filled with the down having undergone the treatment according to the invention presented the following coefficients as a function of the filling rates:

| | |
|---|---|
| 200 grams per square meter | PA = 81.6 |
| 250 grams per square meter | PA = 85.4 |
| 300 grams per square meter | PA = 87.3 |

In order to obtain the same adiathermic power, it is seen that, in the case of a duvet filled with the down according to the invention, half the quantity is used with respect to the quantity necessary when using the conventional down.

It is clear that the process of the invention may be used for pure down, and down containing a variable proportion of small downy feathers.

The process of the invention, which has been described hereinabove and illustrated in FIG. 3 as working in unitary loads, may also be carried out continuously.

The cylinder 4 may in that case be of long length and along a slightly inclined axis; the down introduced in the highest part would be discharged in the lowest part after having slowly passed through the cylinder, passing in a first phase corresponding to a dehydration phase in which it is subjected to a stream of hot air, then to a phase of coating by the resin solution mist followed by the final phase of polymerization by increase in temperature with subsequent cooling.

What is claimed is:

1. Process for the treatment of insulating materials in ths supple, fluffy state, such as down, and intended for filling body-protecting structures, said process comprising the step of subjecting the fluff of the down to a physical treatment adapted to take the filament of the fluff into a substantially radial position, giving the fluff its maximum volume, wherein said treatment includes a suspension of the down fluff in a dry gaseous atmosphere at a temperature of the order of 100° C.

2. A process for treatment of insulating materials in the supple, fluffy state and comprising a plurality of filaments, such as down, and intended for filling body protection structures, the process being adapted to fix said filaments of the fluff into a substantially radial position giving the fluff its maximum volume and its maximum insulating properties, wherein said treatment comprises:

(a) introducing the fluff in suspension in a rotating enclosure;

(b) insufflating a stream of hot air at the base of the said enclosure while the air is evacuated at the top of said enclosure;

(c) progressively raising the temperature of the air to about 100° C. until the means hygrometric degree of the air imprisoned within each piece of the fluff has been reduced to a level of between 20 and 25% corresponding to the filaments having been placed in a substantially radial position;

(d) stopping the introduction of hot air whilst said enclosure is maintained in rotation, maintaining the fluff in eddies, and at the same time insufflating into the volume of said enclosure a coating resin in an organic solvent in the state of mist, leading the fluff, whose filaments are in a radial position, to be regularly impregnated on the surface thereof;

(e) evacuating the solvents at the top of said enclosure, and (f) insufflating hot air at about 130° C. at the base of said enclosure whilst continuing to rotate said enclosure, so as to cause the polymerization of the coating resin, thereby stabilizing the fluff in expanded and developed state of the filaments.

3. A process for the treatment of insulating materials in the supple, fluffy state, such as down, and intended for filling body-protecting structures, comprising the successive steps of:

(a) subjecting the material to a phase of expansion and of dehydration adapted to take the filaments of the fluff into a substantially radial position giving the fluff its maximum volume by placing in suspension in a stream of a hot gas for the time necessary to ensure thorough dehydration;

(b) subjecting the material in the substantially anhydrous state to coating by a resin in solution in an organic solvent, the solution being projected by spraying;

(c) subjecting the material to a phase of evaporation of the solvent and of polymerization of the coating resin in order to obtain a film covering the surface of each element.

4. The process of claim 1, wherein the coating resin is provided with properties of high surface tension with respect to water and the resin is chosen from the group including fluorocarbon resins and silicon-based resins.

5. The process of claim 4, wherein the coating is effected by spraying a mist of the solution of the resin in an appropriate solvent, under high pressure greater than 3 k/cm$^2$ and in an enclosure containing the down fluff in movement being in suspension in a dry gaseous phase (such as air), said gaseous phase being taken to a temperature at least equal to the temperature of polymerization of the resin.

6. A product obtained by carrying out the process of claim 1 wherein it is constituted by an insulation material in the supple and fluffy state such as down for the purpose of filling supple structures for thermal protection of the body such as eiderdowns, duvets, sleeping bags, anoraks, each individual piece of fluff being in its state of substantially maximum expansion, the filaments being in a substantially radial position and imprisoning therebetween an air phase in the substantially anhydrous state and the filaments comprising a coating film in the solid state and formed by a thin film of resin presenting a high solid/liquid surface tension, particularly with respect to water and ensuring for the fluff a resistance to the humidity of the outside medium.

7. The filling material of claim 6, wherein the coating resin is selected from the group including fluorocarbon resins and silicon resins.

8. Insulating structures in supple and deformable form for insulation of the body, of the type constituted by an outer envelope and an internal filling in the form of down such as eiderdowns, sleeping bags, duvets or anoraks, wherein the unitary elements constituting the filling material are in accordance with claim 7.

9. The process of claim 2 wherein the coating resin is provided with properties of high surface tension with respect to water, and the coating contains at least one component selected from the group consisting of fluorocarbon resins and silicon resins.

10. The process of claim 9 wherein the coating is effected by spraying a rist of the solution of the coating resin in an appropriate solvent under pressure greater than 3 $k/cm^2$.

11. The process of claim 2 wherein the fluff is introduced and maintained in suspension in a rotary drum with perforations over its wall and is contained in an enclosure, the hot air being insuflated at the base of said enclosure and evacuated at the top thereof, and the step of insufflating a coating resin in an organic solvent is conducted by spraying the coating resin and solvent at the center of the drum which is maintained in rotation.

* * * * *